United States Patent [19]

Stein

[11] Patent Number: 5,002,512

[45] **Date of Patent: * Mar. 26, 1991**

[54] APPARATUS FOR FORMING AND CONTROLLING LARGE-VOLUME BUBBLES

[76] Inventor: David B. Stein, 817 W. End Ave. #2D, New York, N.Y. 10025

[ * ] Notice: The portion of the term of this patent subsequent to Mar. 31, 2004 has been disclaimed.

[21] Appl. No.: 274,615

[22] Filed: Nov. 23, 1988

Related U.S. Application Data

[60] Continuation of Ser. No. 30,162, Mar. 25, 1987, abandoned, which is a division of Ser. No. 714,978, Mar. 22, 1985, Pat. No. 4,654,017.

[51] Int. Cl.[5] ..... A63H 33/28

[52] U.S. Cl. ..... 446/15

[58] Field of Search ..... 446/15, 16, 21; D21/61

[56] References Cited

U.S. PATENT DOCUMENTS

| | | | |
|---|---|---|---|
| 1,020,708 | 3/1912 | Marshall | 446/20 |
| 2,391,797 | 12/1945 | Raspet | 446/21 |
| 2,514,009 | 7/1950 | Raspet | 446/15 |
| 2,606,395 | 8/1952 | Fulton | 446/15 |
| 2,928,205 | 3/1960 | Fulton | 446/15 |
| 3,064,387 | 11/1962 | Campbell | 446/21 |
| 3,545,126 | 12/1970 | Brown | 446/236 |
| 4,152,864 | 5/1979 | Habisohn | 446/15 |

OTHER PUBLICATIONS

"Soap Bubbles and the Forces Which Mold Them", C. V. Boys, Doubleday and Company, 1959.

"Bubbles", Bernie Zubrowski, "Straws and String", pp. 18, 19; published by Little, Brown and Co. 1979.

"Ephemeral Sculpture Machine", Felix Cartagena.

"The Unbelievable Bubble Book" (copy of Page 33), John Cassidy, Klutz Press 1987.

*Primary Examiner*—Mickey Yu

*Attorney, Agent, or Firm*—Gottlieb, Rackman and Reisman

[57] ABSTRACT

This apparatus for "Forming and Conrolling Large-Volume Bubbles" consists essentially of four elements: First, a bubble-forming loop made of a flexible, large-pore (substantially noncapillary) material able to store large quantities of bubble solution by adhesion to a large surface area, by formation of numerous small reservoirs in the large pores, and by surface tension in the solution film enclosing the loop material, said film uniting with the solution stored within and able to release the solution quickly to an expanding bubble; second, means of supporting said bubble-forming loop; third, means of controllably opening and closing the bubble-forming loop while minimizing reliance on inertial or centrifugal forces; and fourth, means of maximizing continuity of supply of solution to the bubble-forming loop. Soap bubbles up to eight feet across have been made with the apparatus.

3 Claims, 6 Drawing Sheets

APPARATUS FOR FORMING AND CONTROLLING LARGE-VOLUME BUBBLES

This application is a continuation of application Ser. No. 030,162, filed Mar. 25, 1987, which is a division of application Ser. No. 714,978, filed Mar. 22, 1985, U.S. Pat. No. 4,654,017.

This invention relates to an apparatus for forming and controlling large-volume bubbles and introduces an unprecedented degree of control into the art of making large bubbles from soap solution or other liquids.

The fine control given by the apparatus allows enormous bubbles to be started, expanded, carefully "closed", and separated without bursting. Spherical soap bubbles up to eight feet in diameter have been made, and even larger bubbles might be produced by enlarging the apparatus. These huge spherical bubbles are quite stable, depending somewhat on air turbulence, and often last for several minutes before bursting. The ususual stability of these bubbles, which during formation are oblong or pear-shaped, is acheived by the precise controls given by use of the apparatus, which regulate the emerging shape, avoiding bubble necks, and keeping a stable diameter/length ratio.

The apparatus also allows a variety of large non-spherical bubbles to be made, which though less stable, are still spectacular. Tubular, dumbell-shaped, and branching bubbles up to forty feet long, and fifteen feet wide (in the branches) have been produced. Huge double bubbles, triples, clusters, and chains can be created by careful manipulations of the device. Clouds of small bubbles can be created, and small bubbles made to whirl inside larger ones. All this can be accomplished using for example a mixture of ordinary dish detergent and water, which incidentally produces brilliant irredescent colors. The apparatus can be operated by a child, but the largest, most interesting effects challenge the skill of an adult.

OBJECTS OF THE INVENTION

The objects of this invention are set forth as follows:

One object is to provide an apparatus which allows an unprecedented fine degree of control in the art of making large-volume bubbles.

Another object is to provide an apparatus which minimizes any reliance on inertial or centrifugal force for its operation, such forces being relatively difficult to control.

Yet another object is to provide an apparatus which allows making bubbles of unprecedented size.

Yet another object is to provide an apparatus which allows making large bubbles of unusual stability.

Yet another object is to provide an apparatus which allows the operator to close a very large bubble loop, and dip it in a cup or other small container of solution.

Yet another object is to provide an apparatus which maximizes the amount of solution that can be stored and released in the bubble-forming loop and other members, thereby increasing potential bubble size and prolonging continuity of operation.

Yet another object is to provide an apparatus which allows the carefully-controlled "sculpting" of double bubbles, triples, clusters, clouds of small bubbles, and bubbles within a bubble.

Yet another object is to provide an apparatus which is smooth and trouble-free in operation, which avoids uncontrolled jerking, swinging, clogging, twisting, tangling, sticking, spilling of solution, or excessive solution on the operator's hands or person.

Yet another object is to provide an apparatus which allows easy bubble production in still air, moving air, or a strong breeze.

Yet another object is to provide an apparatus of minimum weight, permitting maximum bubble size per unit weight of device.

Yet another object is to provide an apparatus which permits maximum bubble size per unit length of device.

Yet another object is to provide an apparatus which avoids the formation of bubble "blemishes" such as blister bubbles formed uncontrollably on the surface of larger bubbles.

Yet another object is to provide an apparatus which, consistent with lightness, ease of operation, and other objects mentioned above, allows an operator standing on the ground to release large bubbles at maximum height.

Yet another object is to provide an apparatus having the fewest number of functioning parts, each part being as simple and economical to manufacture as possible, without sacrificing control, ease of operation, or aesthetic pleasure.

GENERAL DESCRIPTION OF THE INVENTION

This apparatus for forming and controlling large-volume bubbles consists essentially of the following four elements:

A bubble-forming loop comprised of a flexible, large-pore (substantially noncapillary) material—for example, a loop of chain—able to store large quantities of bubble solution by (1) adhesion to a large surface area, (2) formation of numerous small reservoirs in the large pores, and (3) surface tension in the solution film enclosing the loop material, said film uniting with the solution stored therein, and able to release it quickly to an expanding bubble, Means of supporting said bubble-forming loop—for example, an elongated rod or tube, Means of controllably opening and closing the bubble-forming loop—for example a slide mechanism—while minimizing reliance on inertial or centrifugal forces, and Means of maximizing continuity of supply of solution to the bubble-forming loop—for example a separate solution reservoir.

PRIOR ART

The science classic, "Soap Bubbles and the Forces Which Mold Them", by C.V. Boys, Doubleday and Company, 1959, describes how, in creating a stable cylindrical bubble, the length of the bubble must not exceed three diameters, or constrictions will develop and finally divide or burst the bubble. It follows that to maximize the size of bubbles, an apparatus must (criteria 1) allow precise control of their proportions during formation. It follows further that (criteria 2) a maximum area for the bubble-forming loop is required. And it follows finally that (criteria 3) some means of supplying substantial quantities of solution ot the bubble-forming loop, and releasing them quickly is required.

Bubbles up to three feet in diameter have been reported blown from rigid hoops. Hoops any larger, and the vats of solution needed to dip them in, become very unwieldy. Curtains of solution film have been raised on wire frames many feet high from stationary vats, but these films have never been closed to form bubbles.

U.S. Pat. No. 2,928,205 granted to A.P. Fulton on Mar. 15, 1960 for a "Bubble-Producing Toy", incorporates a bubble loop which opens and closes. However, the opening and closing action is made dependent on inertial and centrifugal forces, which do not allow adequate control for really large bubbles, at least in the Fulton mechanism. Regarding loop size, this is not maximized in the Fulton device (judging by area of bubble loop per unit length of device), wherein half the extended length is a handle. Finally the Fulton patent specifies wicking for the material fo the bubble loop. Although this small-pore (essentially capillary) material is capable of storing quantities of fluid, it is incapable of releasing said fluid quickly in the quantities required by very large bubbles.

Thus neither Fulton's patent nor any prior art satisfies the three criteria set forth above as necssary to maximize bubble size: precise control, maximum loop area, and maximum supply and quick release of solution. These criteria, as will be seen, are met by the apparatus of the present invention.

FIGURES OF THE DRAWINGS

In the drawings, FIG. 1 is a front view of the first form of the apparatus, showing the flexible solution-retaining large-pore member (hereafter referred to as the "bubble-forming loop") in "open" position.

In FIG. 11 the reservoir is held in the hand; in FIG. 12 the reservoir is worn on a shoulder strap.

Figure 21:
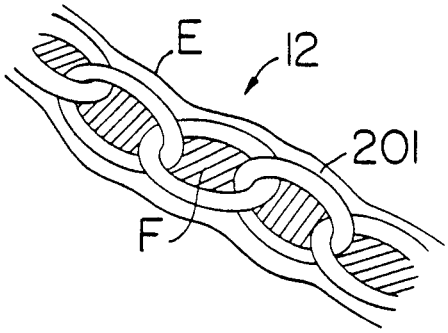
Figure 22:
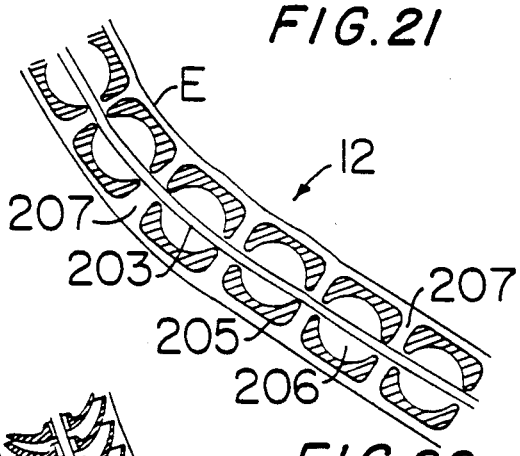
Figure 23:
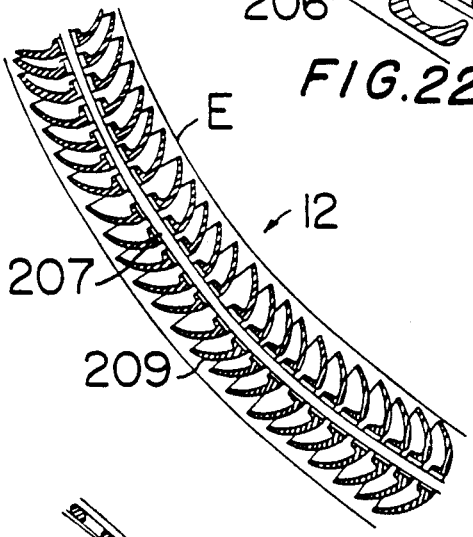
Figure 24:
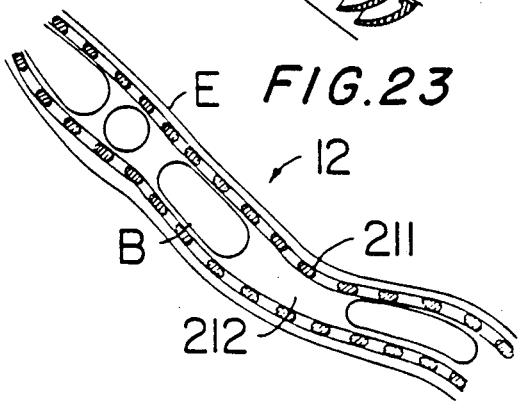
Figure 25:
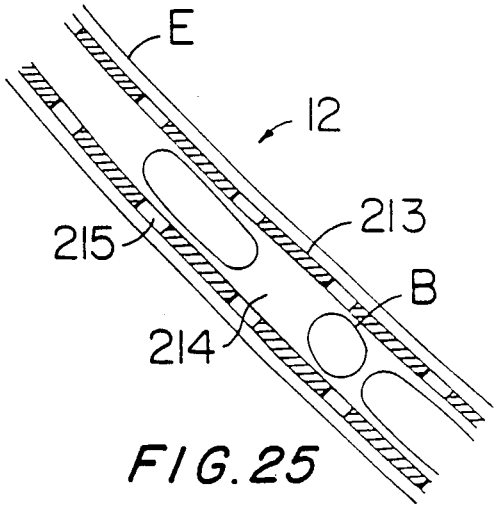
Figure 26:
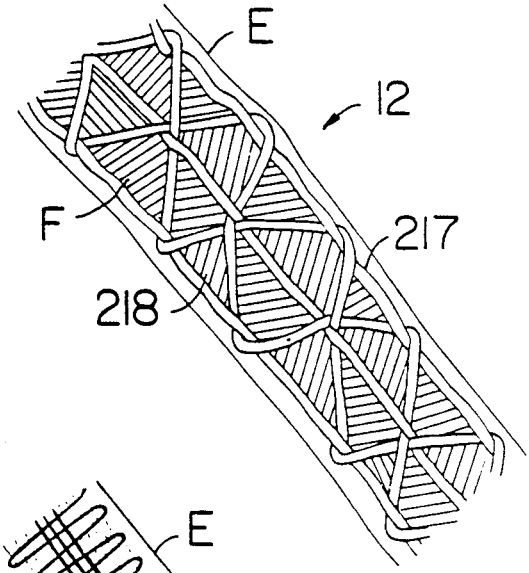
Figure 27:
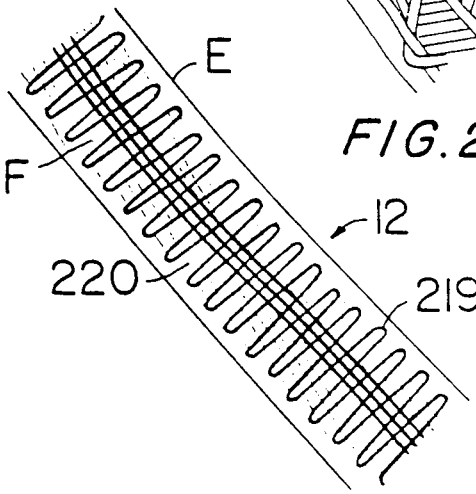

FIGS. 21–27 show different flexible large-pore (substantially noncapillary) materials which can be used for the bubble-forming loop. Specifically, FIG. 21 shows a chain; FIG. 22 shows a string of beads; FIG. 23 shows a string of small reservoir cups; FIG. 24 shows a hollow braid; FIG. 25 shows a perforated hose; FIG. 26 shows a flat braid; and FIG. 27 shows another flat braid.

Figure 28:
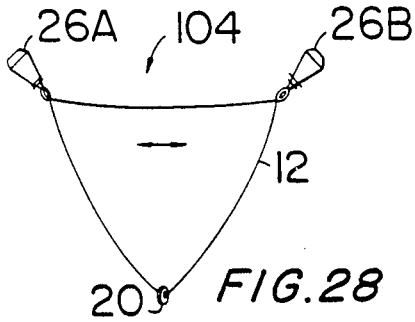
Figure 33:
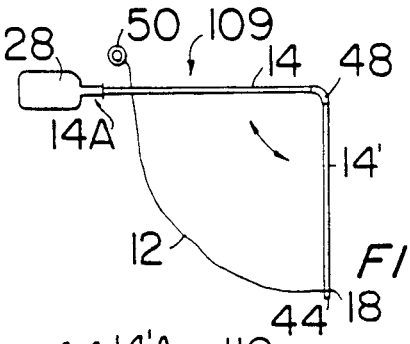
Figure 29:
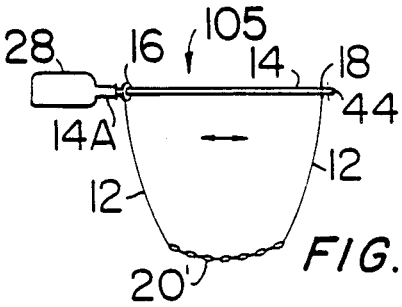
Figure 34:
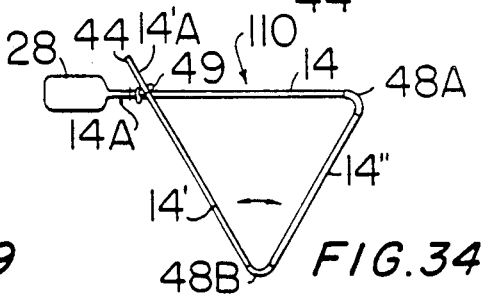
Figure 30:
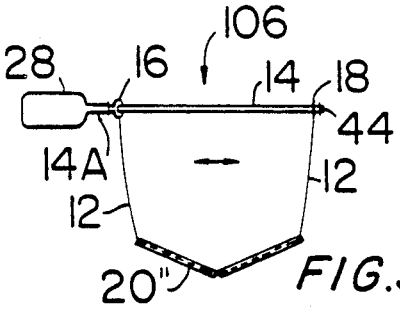
Figure 35:
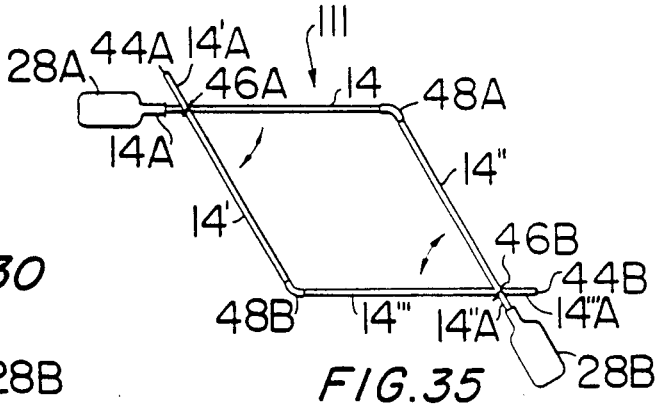
Figure 31:
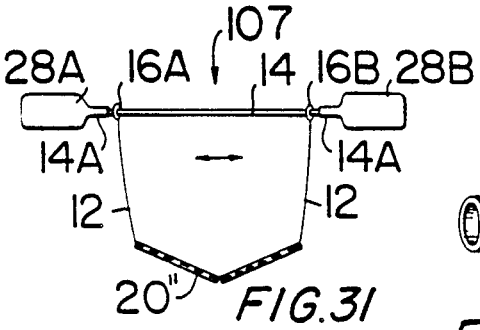
Figure 32:
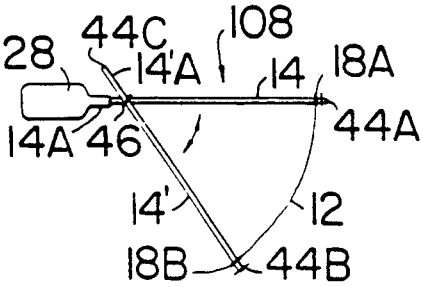

FIGS. 28–35 are front views of additional forms of the apparatus. Specifically, FIG. 28 shows a bubble-forming loop having no supporting rod. FIG. 29 shows a chain substituted for the weight shown in FIG. 1. FIG. 30 shows a pair of short tubes used as the weight. FIG. 31 shows a two-operator apparatus. FIG. 32 shows a "scissor-form" apparatus. FIG. 33 shows a "drawstring" apparatus. FIG. 34 shows a "triangular" apparatus wherein the bubble-forming loop is comprised of three elongated members. And FIG. 35 shows a "parallelogram" apparatus.

Figure 36:
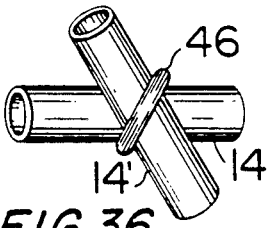
Figure 37:
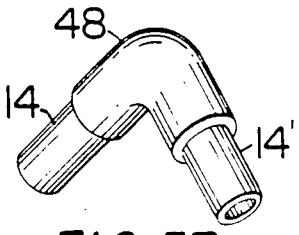
Figure 38:
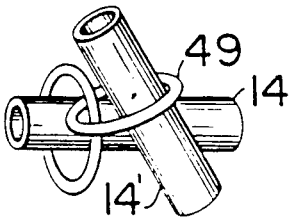
Figure 39:
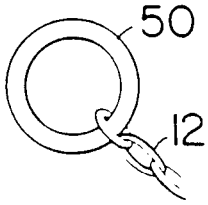

FIGS. 36–39 show typical connections for the apparatus shown in FIGS. 28–35. Specifically, FIG. 36 shows a pivot joint where two rods cross. FIG. 37 shows a flexible elbow, FIG. 38 shows a "two-ring" joint, and FIG. 39 shows a ring handle.

Figure 40:
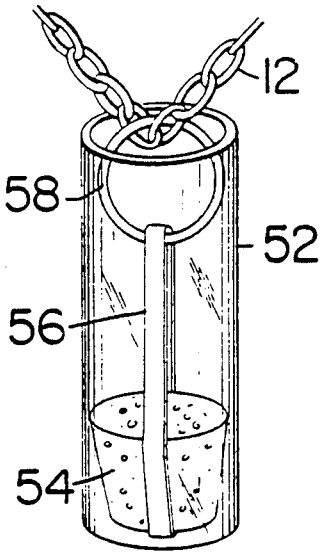
Figure 41:
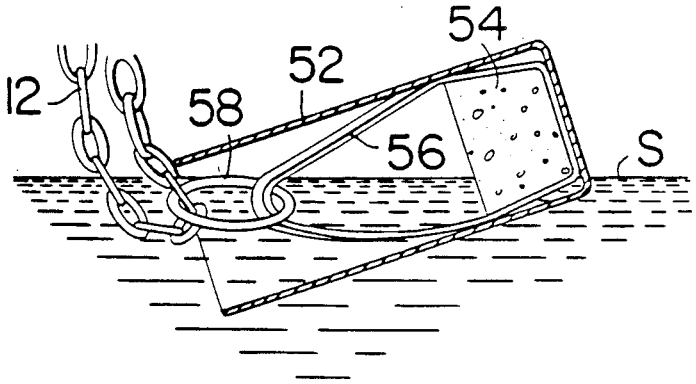
Figure 42:
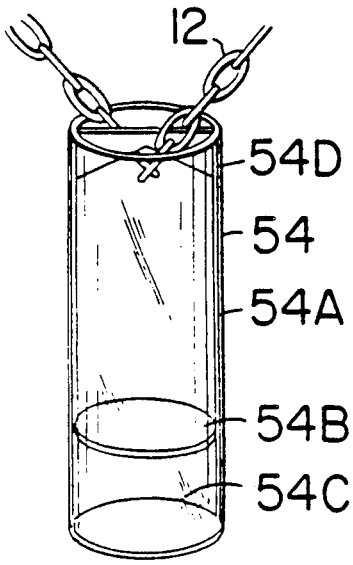

FIG. 40 shows a drip cup. FIG. 41 shows the same drip cup floating in a container of solution. FIG. 42 shows a second form of the dip cup.

DETAILED DESCRIPTION OF THE APPARATUS

Figure 1:
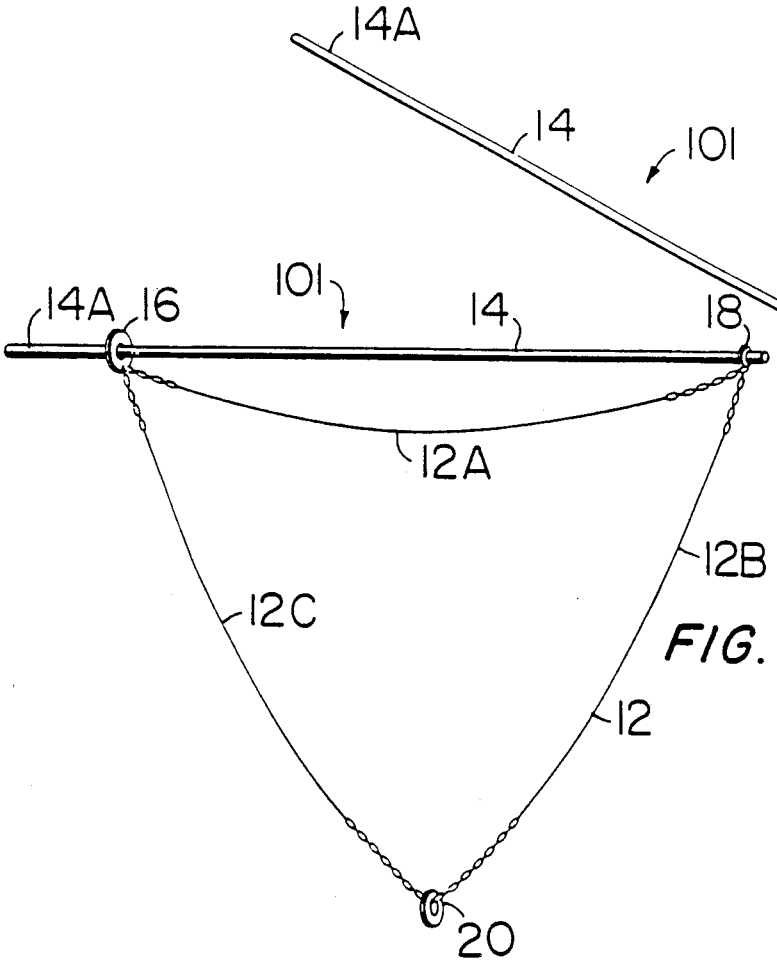

In FIG. 1, the first form of the apparatus 101 is shown in "open" position. The main element is the bubble-forming loop 12, which has a top portion 12A, a front portion 12B, and a rear portion 12C. Loop 12 is shown as a chain, but may be of other materials, for example those shown in FIGS. 21–27. Loop 12 is suspended from a elongated rod or tube member 14, having a handle portion 14A. Member 14 may be of wood, metal, plastic, or similar rigid lightweight material. Loop 12 is connected to member 14 by two means. The first connecting means is slide 16, essentially a ring which can slide along memeber 14. The second connecting means is stop 18, which limits the movement of slide 16. Slide 16 is shown as a metal washer, and stop 18 is shown as a rubber friction ring, but other matrials and shapes are possible. From loop 12 is suspended a stabilizing weight 20, shown here as a washer, but again many other materials and shapes are possible.

Figure 2:
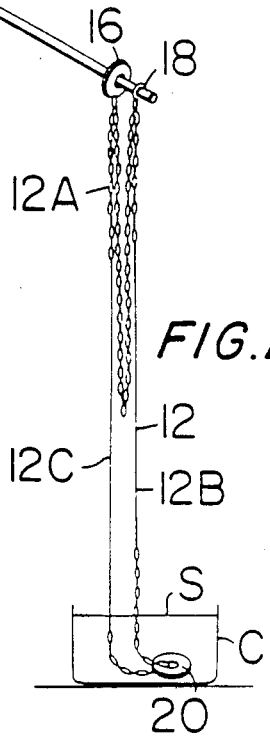
FIG. 2 shows the same apparatus with the loop in "closed " position, and being dipped in a container of bubble solution.

In FIG. 2, the same apparatus 101 is shown in "closed" position, wherein slide 16 has been moved to meet stop 18, and the closed bubble-forming loop 12 is being dipped in a container C of solution S.

Figure 3:
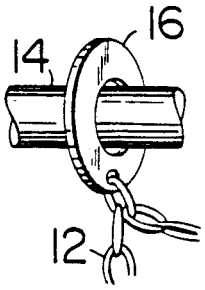
FIG. 3 shows the slide which enables opening and closing of the bubble-forming loop of this form of the apparatus.
Figure 4:
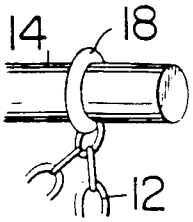
FIG. 4 shows a stop for the slide, which stop also connects the bubble-forming loop to the supporting rod.
Figure 5:
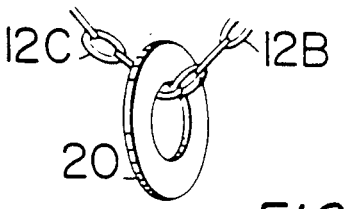
FIG. 5 shows a weight which in this form of the apparatus helps to stabilize th bubble-forming loop and close it precisely.

Details of slide 16, stop 18, and weight 20 are shown in FIGS. 3, 4, and 5 respectively.

Figure 6:
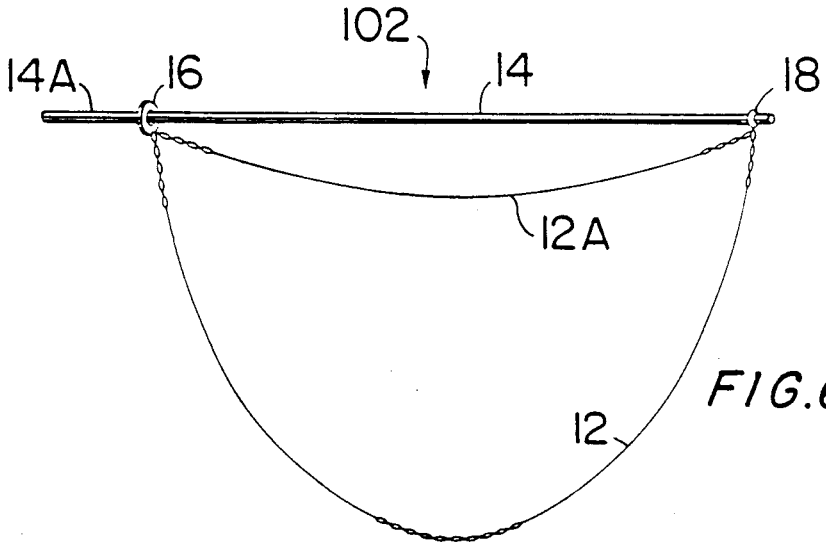
FIG. 6 shows a second form of the apparatus which omits the weight.

FIG. 6 shows the second form 102 of the apparatus, which omits weight 20.

Figure 7:
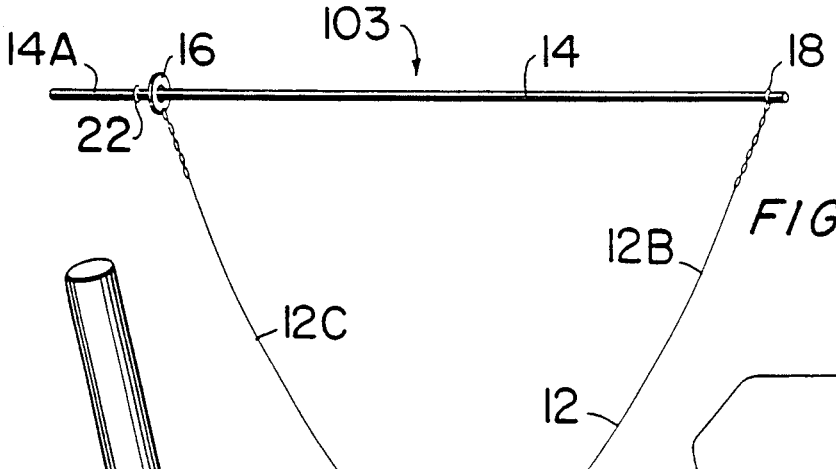
FIG. 7 shows a third form of the apparatus, wherein the supporting rod acts as the upper portion of the bubble-forming loop.
Figure 8:
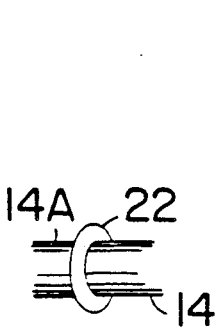
FIG. 8 shows a stop used on the third form of the apparatus, to keep solution from running into the handle.

FIG. 7 shows the third form 103 of the apparatus, which omits the top portion 12A of bubble-forming loop 12 and adds a stop 22 to prevent solution form running along member 14 onto handle portion 14A. Stop 22, which is detailed in FIG. 8, is shown as a rubber friction ring, but could take many other forms.

Figure 9:
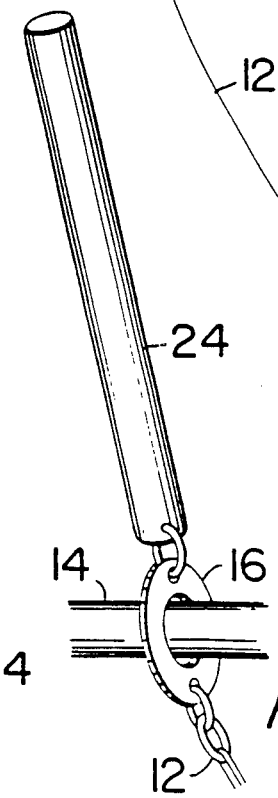
FIG. 9 shows a handle added to the slide.

In FIG. 9, a handle 24 is added to slide 16. Handle 24 can be of wood, metal, plastic or other rigid, lightweight material. In larger models of the apparatus, handle 24 can be quite long, and function as a pushrod.

Figure 10:
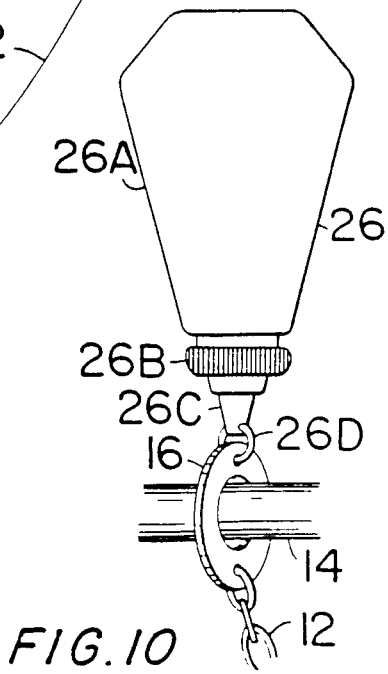
FIG. 10 shows a solution reservoir which can be added to the slide.

In FIG. 10, a solution reservoir 26 is added to slide 16. Reservoir 26 has a body 26A, a screwcap 26B, and an adjustable drip nozzle 26C. This is a common squeeze bottle. The one represented is a mustard bottle manufactured by the Crown Glass Company of Chicago, Ill. A rigid metal clip 26D connects reservoir 26 to slide 16.

Figure 11:
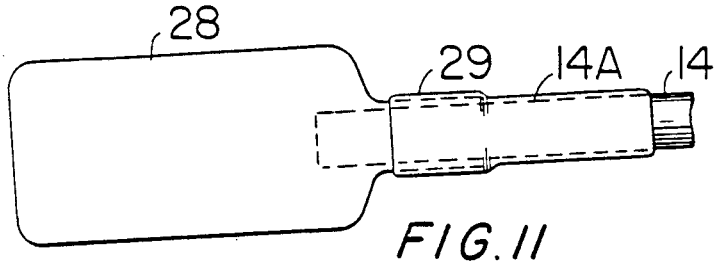
FIGS. 11 and 12 show two forms of reservoir which can be used in larger models of the apparatus.

In FIG. 11, a solution reservoir 28 is shown which can be added to larger models of the apparatus. In these large models, elongated member 14 is a rigid hollow tube. It's handle portion 14A is shown fit by friction into reservoir 28, with the joint made watertight by a flexible rubber sleeve 29. Alternatively, tube 14 and reservoir 28 could be joined by male and female threading, or they could be cast integrally in one piece, for example in plastic.

Figure 12:
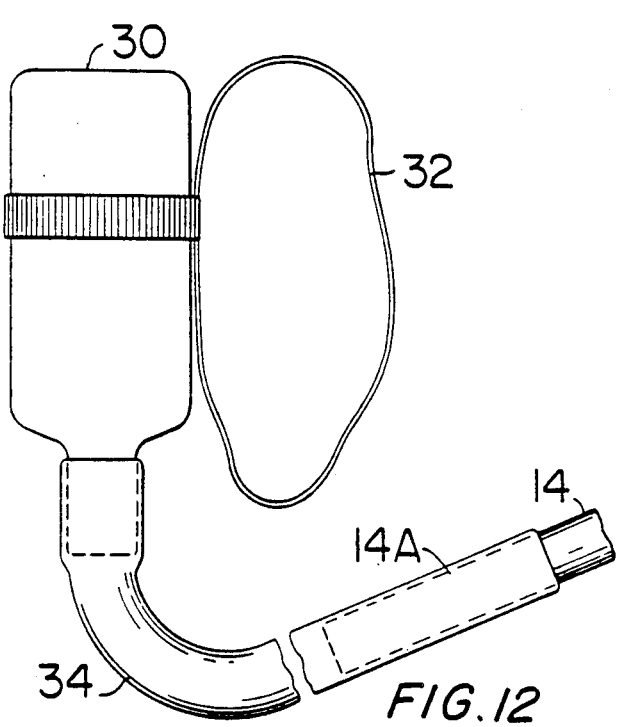

In FIG. 12, which also relates to larger models of the apparatus, a similar reservoir 30 is supported by a shoulder strap 32, which may be of leather, canvas, flexible plastic or the like. Reservoir 30 is connected to handle portion 14A of tube 14 by a flexible hose 34, which may be rubber or plastic.

Figure 13:
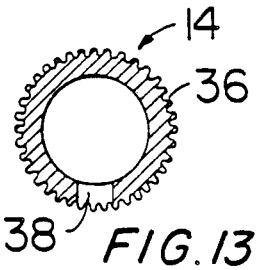
FIG. 13 shows a cross section of the perforated tube used in some larger forms of the apparatus, showing the tube's surface deformed, for example fluted, to increase solution storage on its surface.

In the larger models of the apparatus mentioned above, elongated hollow tube 14 might have a cross-section like that shown in FIG. 13, wherein large-pore surface deformities 36, shown here as flutes, increase solution storage capacity. Note also the perforations 38 which enable solution to feed through to the surface of tube 14.

Figure 14:
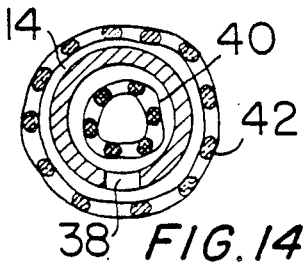
FIG. 14 shows an alternate type of perforated tube in which a large-pore material, for example a hollow braid, can be inserted, or used to sheath the tube, or both.

In FIG. 14, an alternate cross-section for hollow tube 14 is shown. A large-pore solution-retaining material 40 can be threaded through tube 14, or a similar material 42 be used to sheath tube 14, or both. The large-pore materials illustrated are two sizes of polypropylene hollow braid manufactured by the Crowe Rope Company of Warren, Me. Hollow cotton braid, manufactured by the same company, or tubular nylon netting available from pantyhose suppliers, and other similar materials are also suitable.

Figure 15:
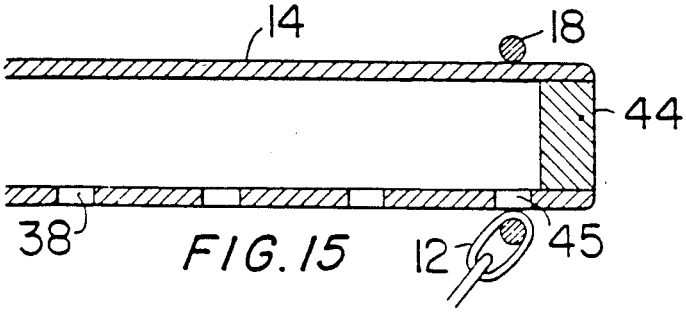
FIG. 15 is a longitudinal section at the end of the hollow tube, showing the perforations and an end plug.

In FIG. 15, an end plug 44 limits movement of solution through hollow tube 14, and forces the solution through perforations 38. An end perforation 45 is located at the attachment point of flexible member 12, so that solution feeds directly into member 12.

Discussion of FIGS. 16–20, which relate to "operation of the apparatus" will be included later under that heading.

In FIG. 21, a chain 201 is used as the flexible large-pore loop member 12. During operation of the apparatus, soap films F (shown hatched) close off the "large-pore" openings in the chain links, creating a small reservoir of solution adhering and pooling in each one. A film envelope E created by surface tension encloses the entire chain 201, unites with the solution stored therein making it available to an expanding bubble. Chain 201 may be of metal, plastic, or other materials formable into links.

In FIG. 22, a string 203 of beads 205 is used as loop member 12. Solution is stored in the central cavity 206 of each bead 205, in the gap 207 between any two beads, and also within the film envelope E. The beads 205 may be of metal, plastic, or similar rigid materials, and can vary as to shape, dimension, surface texture, and size of the central cavity 206. String 203 can alternately be made of cord, chain, fishline, hollow braid, and similar flexible materials.

In FIG. 23, a string 207 of reservoir cups 209 is used as flexible loop member 12. Solution is stored in the cups 209, and also inside the enclosing film envelope E. The cups 209 may be of metal, plastic, or other material formable to a concave shape. (Materials like these are readily available through (New York jewelry wholesalers.)

In FIG. 24, a hollow braid 211 is used as flexible loop member 12. Small bubbles B form inside braid 211, partitioning off the interior to form "large pores" 212 able to store solution. A film envelope E encloses the entire braid 211, uniting with the solution stored therein and able to release it quickly to an expanding bubble. As mentioned earlier, hollow braid 211 may be of polypropylene, cotton, or similar flexible woven materials.

In FIG. 25, a hose 213 having perforations 215 is used as flexible loop member 12. Small bubbles B partition off the interior of hose 213, creating "large pores" 214 able to store solution. A film envelope E encloses the entire member 213, which may be of rubber or flexible plastic.

In FIG. 26, a flat braid 217 is used as flexible loop member 12. Braid 217 can be of cotton, nylon, or similar flexible woven materials, and have many other configurations than the particular pattern shown. (Many varieties of woven braid are available through garment trim wholesalers.) During operation, soap films F form in the "large-pore" gaps 218, creating numerous small reservoirs able to store solution. A film envelope E encloses the entire member 217.

In FIG. 27, another flat braid 219 is used as flexible loop member 12. Again, during operation, soap films F form numerous small reservoirs in the "large-pores" gaps 220, and a film envelope E encloses the entire member 219.

In FIG. 28 a fourth form 104 of the apparatus has a flexible loop member 12 which carrys a weight 20. Loop 12 is supported at two points by squeeze bottles 26A and 26B, which can be similar to the sqeeze bottle shown in FIG. 10. Instead of squeeze bottles, loop 12 could also be supported by two ring handles 50, as shown in FIG. 39. In large models of this form 104 of the apparatus, a rod 24 similar to the rod shown in FIG. 9 could be added to each ring-handle 50.

In FIG. 29, a fifth form 105 of the apparatus has a flexible loop member 12, whose lower portion is replaced by a chain 20', which serves as a weight. Member 12 is connected by slide 16 and stop 18, in a manner similar to that shown in FIG. 3, to a hollow perforted tube 14. Solution feeds from reservoir 28, as shown in FIG. 11, through handle portion 14A of tube 14 unitl it reaches end plug 44.

In FIG. 30, a sixth form 106 of the apparatus is the same as shown in FIG. 29, except that a pair of short rigid tubes 20'' are used as a weight. These may be of metal, plastic, or another rigid tubular material.

In FIG. 31, a seventh form 107 of the apparatus intended for two operators is shown. It has two reservoirs 28A and 28B, which feed solution into perforated tube 14. Two slides 16A and 16B can be used to open and close loop 12. Pushrods as shown in FIG. 9 can be added to both slides 16A and 16B for very large models.

In FIG. 32, an eighth form 108 of the apparatus is shown. Two perforated tubes 14 and 14' are joined "scissor fashion" by a pivot joint 46, which is shown as a rubber friction ring in FIG. 36. A reservoir 28 feeds solution through handle portion 14A of tube 14. Movement of fluid in tubes 14 and 14' is limited by end plugs 44A, 44B, and 44C. A flexible member 12 is connected to tubes 14 and 14'' by stop members 18A and 18B as shown previously in FIG. 4.

In FIG. 33, a ninth form 109 of the apparatus is shown. Two perforated tube members 14 and 14' are joined by a flexible elbow 48, which is detailed in FIG. 37. Solution feeds from reservoir 28 through handle portion 14A to tubes 14 and 14'. The movement of solution is limited by end plug 44. A flexible member 18 is connected "drawstring fashion" to tube 14' by a friction ring 18 like the one shown in FIG. 4. The other end of member 12 is connected to a ring handle 50, which is detailed in FIG. 39.

In FIG. 34, a tenth form 110 of the apparatus is shown. Three perforated tubes 14, 14', and 14" are connected by flexible elbows 48A and 48B, and also by a "two-ring" joint 49, which is detailed in FIG. 38. A reservoir 28 feeds solution through handle portion 14A to the bubble-forming "loop" thus created. Tube member 14' has a handle portion 14'A and an end plug 44 to limit movement of solution.

In FIG. 35, an eleventh form 111 of the apparatus is shown. It has four perforated tubes 14, 14', 14", and 14"' joined by flexible elbows 48A and 48B, as detailed in FIG. 37, and joined also by two pivot joints 46A and 46B, as detailed in FIG. 36. Two solution reservoirs 28A and 28B feed through handle portions 14a and 14"A. Tubes 14' and 14"' also have handle portions 14'A and 14"'A respectively. End plugs 44A and 44B limit movement of solution.

In FIG. 36 a typical pivot joint 46 connects two hollow tubes 14 and 14'. Joint 46 is shown as flexible rubber friction ring, but could also be a metal pin penetrating both tubes in some cases, or some other pivoting connection.

In FIG. 37, a typical flexible elbow joint 48 connects two hollow tubes 14 and 14', allowing solution to pass between them. Elbow 48 is shown as flexible rubber or plastic hose. It could be other flexible tubular materials, for example hollow braid. If, as shown in FIG. 14, a hollow braid 42 sheathes the tube members, then elbow 48 could be just a continuation of the sheathing material.

In FIG. 38, a "two-ring" joint 49 connects two elongated tubes 14 and 14', allowing them to slide past one another. Joint 49 can be of metal or plastic or another smooth-sliding rigid material.

In FIG. 39, a ring handle 50 is attached to a flexible member 12, shown here as a chain. Ring handle 50 may be of metal, plastic, or any material offering a good grip for the fingers.

In FIG. 40, drip cup 52 can substitute for weight 20 (see FIG. 5) in some forms of the apparatus. Drip cup 52 contains a means of flotation 54 at its lower end, for example a cork, or other nonabsorbent material which will float in the solution. This form 52 of the drip cup is suspended from bubble-forming loop 12 by a ring 58, linked to a rubber band 56, which is looped around cork 54 and friction fit with cork 54 into cup 52. Ring 58 can be of metal, rubber, plastic or any noncorroding material, and connecting band 56 can be rubber, string, or similar flexible material.

In FIG. 41, drip cup 52 is shown floating half-immersed in a container of bubble solution S.

In FIG. 42, a second form 54 of the drip cup has a cup portion 54A, a partition 54B, a flotation or "air pocket" portion 54C, and a connection portion 54D used to suspend the drip cup from bubble-forming loop 12. Drip cup 54 is cast all of one piece, and may be of plastic, rubber, metal, or other lightweight noncorroding material.

Regarding size, forms 101, 102, and 103 of the apparatus work very well and comfortably when the elongated member 14 is less than five feet long. When member 14 is longer, then push-rod 24, as shown in FIG. 9, becomes very helpful. With even greater length, member 14 must become a hollow tube for reasons of lightness. Then, if reservoir 28 or 30, as shown in FIGS. 11 and 12, is added, the length of a one-man apparatus can go to ten feet or so. Potentially, the two-man forms of apparatus shown in FIGS. 31 and 35 could be even larger, with the ultimate limits being a matter for future experiment.

Although this invention was developed in relation to the specific problem of making large soap bubbles, the same basic elements could possibly be adopted for large bubble production with other liquids, for example molten glass or plastic. Domes of such materials could conceiveably be created on an architectural scale, either in a factory environment with temperature, pressure, and other critical factors being carefully controlled, or with more relaxed controls on the construction site itself.

Operation of the apparatus

Production of a typical large bubble starts as shown in FIG. 2. One hand of the operator grasps the handle portion 14A, while the fingers of the other hand grasp slide 16, holding it against stop 18. The closed bubble-forming loop 12 is dipped in container C of solution S. When the entire loop 12 has been wetted in solution S, it is vertically withdrawn, and excess solution is allowed to drain back into the container. Rod 14 is then held approximately horizontal as shown in FIG. 1, and the operator begins moving slide 16 away from stop 18, thus opening loop 12, and stretching out a film of solution over the opening formed by lengths 12A, 12B, and 12C. This is coordinated with a slow broadside motion (perpendicular to the plane of FIG. 1) of the apparatus through the air if the air is still, or a sensistive exposure to whatever breeze or gusty conditions exist.

Figure 16:
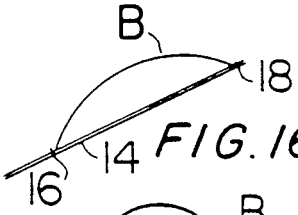
FIGS. 16–19 are plan views of the apparatus in sequential stages of forming a typical large bubble.
Figure 17:
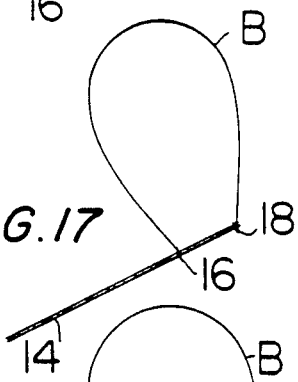
Figure 18:
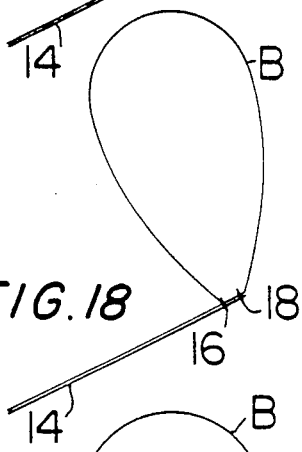
Figure 19:
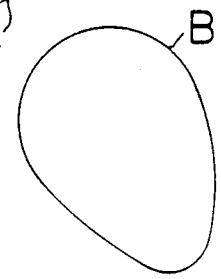

Successful production of really large bubbles requires a precise and carefully-timed movement of slide 16 from closed position to open position and back again as shown in FIGS. 16–19. (These are plan views of the apparatus when rod 14 is held horizontal as shown in FIG. 1.) In FIG. 16, the slide 16 has been quickly moved from closed position (next to stop 18) to fully opened position. This starts the bubble B expanding right away to the largest possible diameter. In FIG. 17, the main volume of bubble B has been established, and the slide 16 is being slowly moved back towards the stop 18, creating a conical "tail" for the bubble, without constricting necks. In FIG. 18, the slide 16 is almost closed at stop 18, and bubble B is about to separate from the apparatus. Note that the length of the bubble is less than three times its diameter, a requirement for stability as discussed previously. In FIG. 19, separation has been achieved, and the newly-formed oblong bubble is seen adjusting itself towards the stable spherical form.

A series of such bubbles can be blown by opening and closing the slide 16 until the solution stored in member 12 is finally exhausted. Then member 12 must be closed and dipped in solution again, as in FIG. 2.

Weight 20 as shown in FIG. 1 and elsewhere enhances control of bubble formation. It holds the sides of member 12 straight, dampens their oscillation, and allows member 12 to be neatly and precisely closed. Where member 12 is a relatively heavy chain, however, the added weight 20 is sometimes unnecessary and so in the second form 102 of the apparatus (see FIG. 6), it is omitted.

The operation of the third form of the apparatus 103 (see FIG. 7) is essentially the same as described above, except that rod 14 forms the top edge of the bubble-forming loop.

Several alternate methods of supplying rod 14 with solution are possible. One method is to use slide 16 as shown in FIG. 2 to spread solution up from container C onto rod 14. Passing slide 16 several times up from the container and along rod 14 will accomplish this. To avoid excessive solution on the operator's hand, the handle or pushrod 24 shown in FIG. 9 can be provided.

A second method of supplying solution to rod 14 is the reservoir shown in FIG. 10. The rservoir body 26A serves as a handle. In FIG. 2, when loop 12 is completely immersed in the container C of solution S, then slide 16 and the added reservoir 26 will be in position to suck up solution. This solution can then be dripped or squirted all along rod 14 during operation, thus providing a continuous and precisely-controllable feed of solution to the top edge of the bubble-forming loop. Then, in draining downwards via the bubble film, the solution also feeds member 12, thus allowing long series of large bubbles to be created without interruptions for dipping. This makes bubble production almost independent of any need for container C.

Where member 14 is a hollow tube, the reservoirs 28 or 30 (see FIGS. 11 and 12) can be used to supply solution to the apparatus. Becuase the fluid stored in such a reservoir will seek its own level, handle portion 14A will usually be full of fluid. A quick dip downwards of tube 14 will send a pulse of fluid shooting instantly down its length. Tilting the far end of tube 14 downwards will fill it entirely. Thus a controllable amount of solution can be fed continuously through tube 14.

FIG. 13 shows how this solution can penetrate through perforations 38 to the large-pore deformations 36 (shown as flutings) on tube 14 and be stored there for quick release. Note that by a slight quarter or half-turn of tube 14 round its own longitudinal axis, the operator can rotate the perforations 38 upwards, reducing the amount of solution able to drain out. This gives an additional fine control over solution flow even at the far end of tube 14.

In FIG. 14, the large-pore member 40 inserted in tube 14 can slow the pulse of fluid shooting through, and retain it longer after the far end of tube 14 is tilted upwards again. The large-pore exterior sheath 42 also adds to the storage capacity. Inside and out, tube 14 can thus be controllably kept sopping wet with solution.

As indicated in FIG. 15, tube 14 can also supply solution directly through a perforation 45 to the top part of bubble-loop 12.

Figure 20:
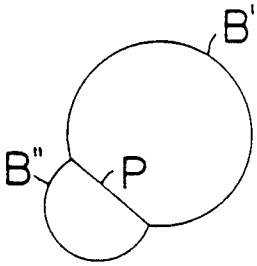
FIG. 20 is a double bubble formed by the apparatus.

Double bubbles like that illustrated in FIG. 20 are made first be setting free one bubble B′, and then passing the front side 12B of loop 12 (see FIG. 1) through it while making a second bubble B″. The two bubbles then float away joined by a "partition" P of film.

Triple bubbles, clusters, and chains are made by repeating the same principle, which also allows the serial "sculpting" of complex bubbles resembling giant "ants", "whales", "bulls", and other fanciful creatures, all dependent on the precise control allowed by the apparatus.

If in FIG. 1, slide 16 is moved to a "half-open" or even narrower position, bubbles which are initially "slab-like" will form, which then oscillate in fascinating ways as they adjust towards spherical form.

The narrowest position, wherein slide 16 almost touches stop 18 will produce clouds of small bubbles. The member 12 can then be opened fully, and a large bubble be made to enclose a swirl of smaller ones.

As stated before, FIGS. 21–27 illustrate how different types of flexible large-pore (substantially noncapillary) materials used for the bubble-forming loop 12 work to store and quickly release quantities of solution.

In FIG. 21, when chain 201 is dipped in solution, virtually no capillary (small-pore) storage occurs. Instead, quantities of solution are stored by adhesion to the large surface area. Also, solution films F (shown hatched) form in each link, creating a small reservoir of solution pooled and adhering in each one. Finally, surface tension creates a film envelope E enclosing the entire member 201, and unified with its contents. Just after dipping in a rich solution, this chain will appear as a fat rope of liquid. Unlike fluid trapped in the fine interstices of a capillary material (which merely adds to the dead weight of the apparatus), this solution can be instantly released.

Similar principles of storage and release apply to FIG. 22. Solution adheres to the large surface area presented by the string 203 and the beads 205, with the central cavities 206 and gaps 207 contributing heavily. Note that when this form of member 12 is in closed position (see FIG. 2), the gaps between beads 205 will be relatively closed, retaining solution stored in the cavities 206. Then, when loop member 12 is opened (see FIG. 1), it's new curved configuration will cause beads 206 to tilt with respect to each other, opening the gaps 207, and quickly releasing fluid. In fact the opening of the gaps will be roughly proportional to the opening of the bubble-forming loop 12, thus "automatically" sizing the dose of fluid released to the size of the bubble being produced. Note the role of film envelope E in containing and uniting the stored solution, as mentioned before.

In FIG. 23, storage and release is again similar. Solution adheres to the vary large (noncapillary) surface area presented by the string 207 and reservoir cups 209. Solution pools in each cup, without necessarily filling it, and film envelope E helps keep the entire series from leaking fluid, until an expanding bubble begins pulling the liquid away.

In FIG. 24, solution is stored on the very large inner and outer surfaces of the hollow braid 211, coating every strand. Film envelope E closes the surface gaps between strands, in effect creating a tube. Just after being immersed in solution, this tube is full of fluid, some of which drains down and out as member 211 is withdrawn from container C, and some of which remains trapped between small bubbles B formed in the irregularities of the interior. As member 12 is raised from container C, weight 20 begins stretching the hollow braid 211 downwards, squeezing out fluid stored inside. This "squeezing out" of interior fluid is especially noticeable when the operator pulls slide 16 full open, stretching the top portion 12A of the bubble-forming loop 12. The released fluid streams down into the expanding bubble film in quantities controllable by the operator.

In FIG. 25, a perforated rubber hose 213 behaves much like the hollow braid 211 discussed above. Solution adheres inside and outside, film envelope E closes the gaps to form in effect a tube, reservoirs of solution are trapped between small bubbles B, and release occurs by stretching which is partially controllable by the operator.

In FIG. 26, showing a flat braid 217, storage occurs by adhesion to the large surface area, by pooling of solution in the gaps closed by soap films F, and by the enclosure provided by film envelope E. The "over-and-under" pattern of the weave allows the gaps to communicate with one another, so that the solution stored therein is continuously united and available to the expanding bubble.

In FIG. 27, showing another flat braid 219, storage and release works exactly the same.

Regarding operation, the forms of apparatus shown in FIGS. 28–35 could all be used to make large bubbles by the same steps shown in FIGS. 16–19, and discussed previously.

In FIG. 28, the apparatus 104 requires one hand to support each of the squeeze bottles (or rods, or ring handles mentioned as alternates). Moving the two support points together closes loop 12, allowing it to be dipped in solution. Moving the two support points apart again opens the loop 12 for bubble production. The double arrow shows the direction of the necessary opening and closing movement.

In FIG. 29, apparatus 105 is operated identically to apparatus 103 with reservoir 28 as discussed previously, except that chain 20' used as a weight widens the lower part of the bubble-forming loop 12, and increases its area.

In FIG. 30, apparatus 106 is again the same as apparatus 103, except that the pair of tubes 20" used as a weight open the lower part of loop 12 even further. The two tubes 20" fold together when loop 12 is closed.

In FIG. 31, the two-man apparatus 107 opens and closes by movement of the two slides 16A and 16B. If tube 14 is very long and somewhat flexible, the two operators can bend it upwards to form an arch, creating an enormous substantially circular bubble-forming loop. The perforated tube 14 is then replenished with solution by lowering the arch momentarily to a horizontal or downward-tilting position. Long pushrods 24 as shown in FIG. 9 are necessary here.

In FIG. 32, the apparatus 108 opens and closes scissor-fashion. The operator grasps the two handle portions 14A and 14'A, closing them together, causing members 14 and 14' to rotate together round common pivot joint 46. During this operation, member 12 folds together also, in two strands that hang slack (much as, in FIG. 1, portion 12A of loop 12 folds and hangs slack during closure). Solution is fed from reservoir 28 to perforated tube 14. When the apparatus is closed, the lower tube 14' will also be primed with solution, and a steady supply will drain down the bubble membrane from tube 14 as operation proceeds. This apparatus has the interesting ability to "flip over" (members 14 and 14' changing places in the diagram), allowing solution accumulated in bottom member 14' to be raised high and used, instead of being lost through runoff.

In FIG. 33, the apparatus 109 opens and closes drawstring fashion, with the two tubes 14 and 14' rotating together around a common flexible joint 48. The weight of tube 14' serves to bow the supporting tube 14, creating a modest arch and somewhat rounder bubble-forming "loop". Excess solution accumulating in tube 14' can be retreived by closing the apparatus, and flipping tube 14' momentarily above tube 14. This will cause solution in tube 14' to drain back through elbow 48 and tube 14 to reservoir 28.

In FIG. 34, the operator grasps the apparatus 110 by handle portions 14A and 14'A. The movement of two-ring joint 49 along tube 14 towards elbow 48A will close the apparatus. Although this apparatus is relatively heavy, it is strongly supported by both hands. Completely under control, it can be lifted over the head, flipped over, and made to open and shut in a vertical or a horizontal plane. The flipping operation can be used to return excess solution accumulated in tubes 14' and 14" to reservoir 28.

In FIG. 35, the two-man apparatus 111 opens and closes like a flexible parallelogram. One operator grasps handle portions 14A and 14'A. The second operator grasps handle portions 14"A and 14'"A. With each operator using his two handle portions scissor-fashion, the opening and closing movement is effected. This potentially huge apparatus can also be lifted high, flipped to recycle solution accumulated in the lower tubes, and be made to open and shut in a vertical or a horizontal plane.

In FIG. 36, the flexible ring 46 allows for the rotating closure shown in FIGS. 32 and 35 to occur.

In FIG. 37, the flexible elbow 48 allows the tubes 14 and 14' to hinge together, and transmits solution from one to the other.

In FIG. 38, the two-ring joint 49 allows tubes 14 and 14' to slide past each other.

And in FIG. 39, the ring handle 50 gives the operator a firm grip in supporting the flexible member 12.

In FIG. 40, drip cup 52 serves to catch solution draining down from bubble-forming loop 12. Ring 58 serves to "center" the solution running down from loop 12 so that it falls into the drip cup 52, rather than off to one side. Then, in FIG. 41, when the drip cup 52 is lowered with bubble-forming loop 12 into the solution S, the means of flotation 54, shown here as a cork, tips drip cup 52 upside down, emptying its contents into the solution container. When loop 12 and drip cup 52 are then raised again, flotation 54 allows drip cup 52 to fill only partially with solution S, leaving room in drip cup 52 for drainage from loop 12 during operation. Meanwhile, the solution stored in drip cup 52 works as a weight, so that drip cup 52 can substitute for weight 20 in some forms of the apparatus.

In FIG. 42, the operation of drip cup 54 is similar, except that an integrally-cast air pocket provides flotation, and connecting portion 54D centers loop 12 on the drip cup.

To sum up, we have now seen many different forms of an apparatus whaich has a flexible bubble-forming loop made of a large-pore material, a means of supporting the loop, a means of controllably opening and closing the loop, and a means of supplying the loop continuously with solution. Each form of the apparatus can substantially satisfy the three criteria set forth previously as necessary to maximize bubble size: precise control, maximum loop area, and maximum supply and quick release of solution. Satisfaction of these criteria distinguishes these forms of apparatus from all prior art, and effects a breakthrough in the art of bubblemaking.

Some changes may be introduced into the forms of apparatus and their components without departing from the real spirit and purpose of this invention. It is my intention to cover by my claims any modified form of structure or use of mechanical equivalents which may reasonably be included within their scope.

I claim:

1. An apparatus for forming large-volume bubbles from a bubble solution, comprising:

a bubble-forming loop capable of storing and releasing substantial quantities of bubble solution, said loop comprising a first shorter portion and a second longer portion;

a weight member connected to said loop second longer portion;

means for supporting said loop; and means for enabling opening and closing of said loop, said solution forming a film stretched across said loop when said loop is opened.

2. The apparatus of claim 1, wherein said weight is slideable along said lower portion of said loop.

3. A method for controllably forming large-volume bubbles from solution, said method comprising the steps of:

supporting a bubble-forming loop at only two points thereon, whereby said loop hangs in a substantially flat vertical plane;

suspending a weight from the lower portion of said loop;

closing said loop by moving said two points together, whereby said loop hangs in a substantially vertical line;

soaking said closed loop with said solution;

opening said loop by moving said two points apart, whereby said solution forms a film stretched across said loop;

causing air to pass through said loop, whereby said film swells outward; and closing said loop by moving said two points together, whereby said film closes to form a bubble and detaches from said loop.

* * * * *